US005251557A

United States Patent [19]

Rohr

[11] Patent Number: 5,251,557

[45] Date of Patent: Oct. 12, 1993

[54] SEWING MACHINE WITH AN EDGE GUIDING DEVICE TO GUIDE ONE OR MORE PLIES OF MATERIAL

[75] Inventor: Günter Rohr, Hemmingen, Fed. Rep. of Germany

[73] Assignee: Union Special GmbH, Stuttgart, Fed. Rep. of Germany

[21] Appl. No.: 967,419

[22] Filed: Oct. 28, 1992

[30] Foreign Application Priority Data

Aug. 7, 1992 [DE] Fed. Rep. of Germany ..... 4226161

[51] Int. Cl.[5] ..... D05B 27/16

[52] U.S. Cl. ..... 112/306; 112/308; 112/322

[58] Field of Search ..... 112/306, 153.1, 322, 112/318, 63, 235; 226/15, 17; 271/227

[56] References Cited

U.S. PATENT DOCUMENTS

| | | | |
|---|---|---|---|
| 3,933,106 | 1/1976 | Murray | 112/235 |
| 4,467,734 | 8/1984 | Rohr | 112/153 X |
| 4,467,739 | 8/1984 | Hagler et al. | 112/235 X |
| 4,681,051 | 7/1987 | Kirch et al. | 112/322 X |
| 4,744,319 | 5/1988 | Rohr | 112/306 |
| 4,823,716 | 4/1989 | Nakashima | 112/306 X |
| 4,827,856 | 5/1989 | Rohr | 112/306 X |
| 4,827,858 | 5/1989 | Horie et al. | 112/306 X |
| 4,836,119 | 6/1989 | Siraco et al. | 112/306 |
| 4,998,493 | 3/1991 | Tanaka | 112/306 X |

FOREIGN PATENT DOCUMENTS

| | | | |
|---|---|---|---|
| 0194182 | 9/1989 | European Pat. Off. . | |
| 2708338C2 | 10/1986 | Fed. Rep. of Germany . | |
| 3917120C2 | 10/1990 | Fed. Rep. of Germany . | |
| 2094195 | 4/1987 | Japan | 112/153 |

*Primary Examiner*—Clifford D. Crowder
*Assistant Examiner*—Larry D. Worrell, Jr.
*Attorney, Agent, or Firm*—Willian Brinks Olds Hofer Gilson & Lione

[57] ABSTRACT

A workpiece guide device on a sewing machine serves for the automatically controlled alignment of a workpiece, with respect to its edge, for the purpose of sewing along the edge of the workpiece at the correct distance from that edge. The circumferential side of a motor-driven guide wheel (36) carries wheels (34) which are likewise motor-driven and which guide the workpiece transversely to the direction prescribed by the guide wheel (36).

12 Claims, 5 Drawing Sheets

SEWING MACHINE WITH AN EDGE GUIDING DEVICE TO GUIDE ONE OR MORE PLIES OF MATERIAL

BACKGROUND OF THE INVENTION

The invention relates to a workpiece guide device for a sewing machine.

SUMMARY OF THE INVENTION

It is known from DE 39 17 120 C2 to provide an edge guide device, having an upper guide wheel and a lower guide wheel, in front of the presser foot of the sewing machine for the purpose of guiding the edges of two workpiece parts separated from one another by an abutment in the form of an intermediate plate. The circumferential sides of the bodies of the two guide wheels carry a large number of freely rotatable rollers disposed transversely to the plane of the wheels. Undesired distortion of the workpiece can occur with this design of the rollers when sewing soft, flexible work material, since, upon starting the sewing operation, the freely rotatable rollers are to be accelerated by means of the workpiece from standstill to the feed speed of the workpiece.

A further edge guide device of a sewing machine for automatically guiding a workpiece part, to be provided with a seam at a distance from its side edges, is described in DE 27 08 338 C2 in which a pinion-like wheel disposed transversely to the feed direction aligns an individual part of the workpiece transversely to the feed direction. In this device, there is also the possibility of undesired distortion of the workpiece in the feed direction, since the pinion-like wheel is frictionally applied to the workpiece to be aligned.

SUMMARY OF THE INVENTION

An object of the invention is to provide a workpiece guide device for the lateral alignment of one or more parts of a workpiece and which makes it possible to align the workpiece part or parts accurately and to guide the workpiece to the stitch-forming location of the sewing machine so as to be virtually free from distortion in the feed direction.

The present invention resides in a workpiece guide device for a sewing machine for the automatically controlled alignment of a workpiece with respect to an edge thereof, the workpiece being movable in a feed direction for the purpose of sewing along that edge of a workpiece at the correct distance therefrom, the guide device having a sensor arrangement for detecting and evaluating the position of said edge, and a motor-driven guide wheel which acts upon the workpiece and against an abutment and whose circumferential side carries wheels which are disposed transversely to the guide wheel in a toroid, and a further motor to which the wheels are connected to be driven thereby in order to guide the workpiece transversely to the direction prescribed by the guide wheel.

By means of the invention, the wheels, which are connected to, and driven by, a motor and which are disposed transversely to the guide wheel in a toroid and guide the workpiece transversely to the direction determined by the guide wheel, make it possible, in a compact type of construction and in a simple and advantageous manner, to align the part or parts of a workpiece accurately and to guide the workpiece to the stitch-forming location of the sewing machine so as to be virtually free from distortion in the feed direction.

BRIEF DESCRIPTION OF THE DRAWINGS

The invention is further described, by way of example, with reference to the accompanying drawings, in which.

DETAILED DESCRIPTION OF THE PREFERRED EMBODIMENTS

Figure 1:
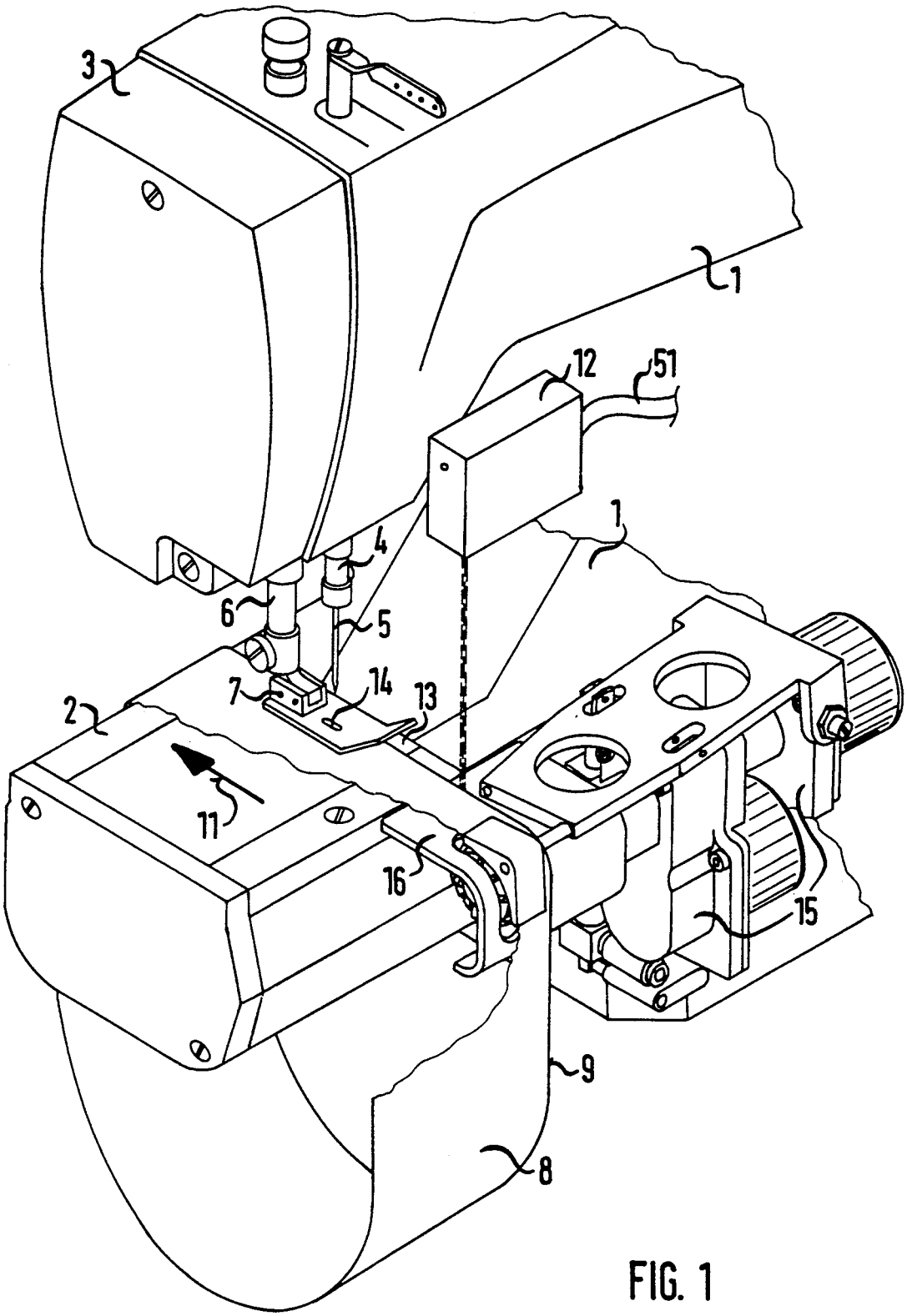
FIG. 1 is a fragmentary, perspective view of a sewing machine having a workpiece guide device.

Referring to FIG. 1, a sewing machine 1 has a workplate 2 and a sewing head 3 in which a needle bar 4, movable up and down, carries a sewing needle 5. A presser bar 6, also movable up and down, is disposed behind the needle bar 4 and a presser foot 7 is secured to the presser bar 6. A workpiece 8 having an edge 9 is disposed below the presser foot 7 and, in a known manner, is conveyed in a feed direction indicated by an arrow 11. A sensor arrangement 12, for detecting and evaluating the position of the edge 9 of the workpiece 8; is disposed on the sewing head 3.

A workpiece guide device 15 is disposed on the sewing machine 1 upstream of a stitch-forming location 14 in the entry region 13 of the presser foot 7. The workplate 2 is supplemented by a guide plate 16 for guiding the, for example, annular workpiece 8.

Figures 2, 3:
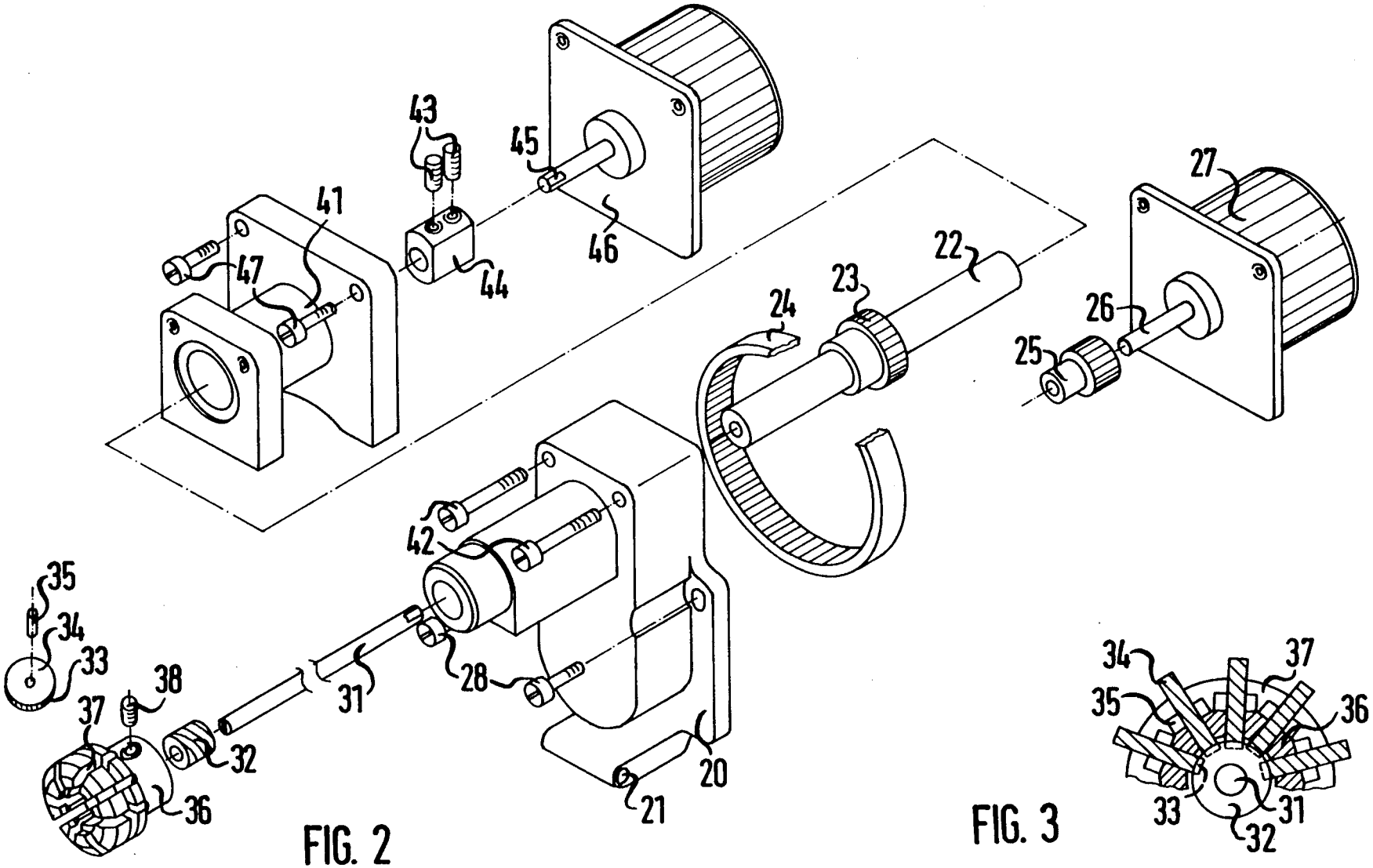
FIG. 2 is an exploded view of a guide device.
FIG. 3 is a fragmentary view of the mounting of the wheels in the guide wheel.

Referring to FIG. 2, the workpiece guide device for the automatically controlled correct alignment of the edge of a workpiece 8, movable in a feed direction for the purpose of sewing along an edge 9 of the workpiece 8 at the correct distance therefrom has a guide housing 20 with a bore 21.

A hollow shaft 22 is rotatably mounted in the guide housing 20 and carries a pinion 23 which is mechanically connected by way of a toothed belt 24 to a further pinion 25 which is in turn positioned on a shaft 26 of a motor 27, such as a stepping motor. The motor 27 is secured to the bottom region of the guide housing 20 by screws 28.

A shaft 31 is rotatably mounted in the hollow shaft 22 and carries at one end a worm 32 which is secured coaxially to the shaft 31 and which is engaged by teeth 33 of wheels 34 which are rotatably mounted on pins 35 in a guide wheel 36. As is shown in the drawing, the guide wheel 36 has, for example, eight openings 37 for mounting the eight wheels 34.

Alternatively, a greater or smaller number of wheels 34 may be advantageous according to the workpiece to be worked. The guide wheel 36 is secured coaxially on the hollow shaft 22 by means of a pressure screw 38, and thus the hollow shaft 22 is also secured axially in the guide housing 20.

An intermediate flange 41 is secured in the upper region of the guide housing 20 by screws 42. The shaft 31, whose free end projects beyond the hollow shaft 22 when in the fitted state, is connected by pressure screws 43 and a coupling piece 44 to a shaft 45 of a further motor 46, such as a stepping motor, which is in turn secured to the intermediate flange 41 by screws 47.

FIG. 3 shows a cutaway portion of the radial mounting of the wheels 34 with their pins 35 in the openings 37 of the guide wheel 36. The wheels 34 are disposed in a toroid transversely to the guide wheel 36, and their teeth 33 engage the worm 32 secured to the shaft 31 and thus form a gear mechanism.

Figure 4:
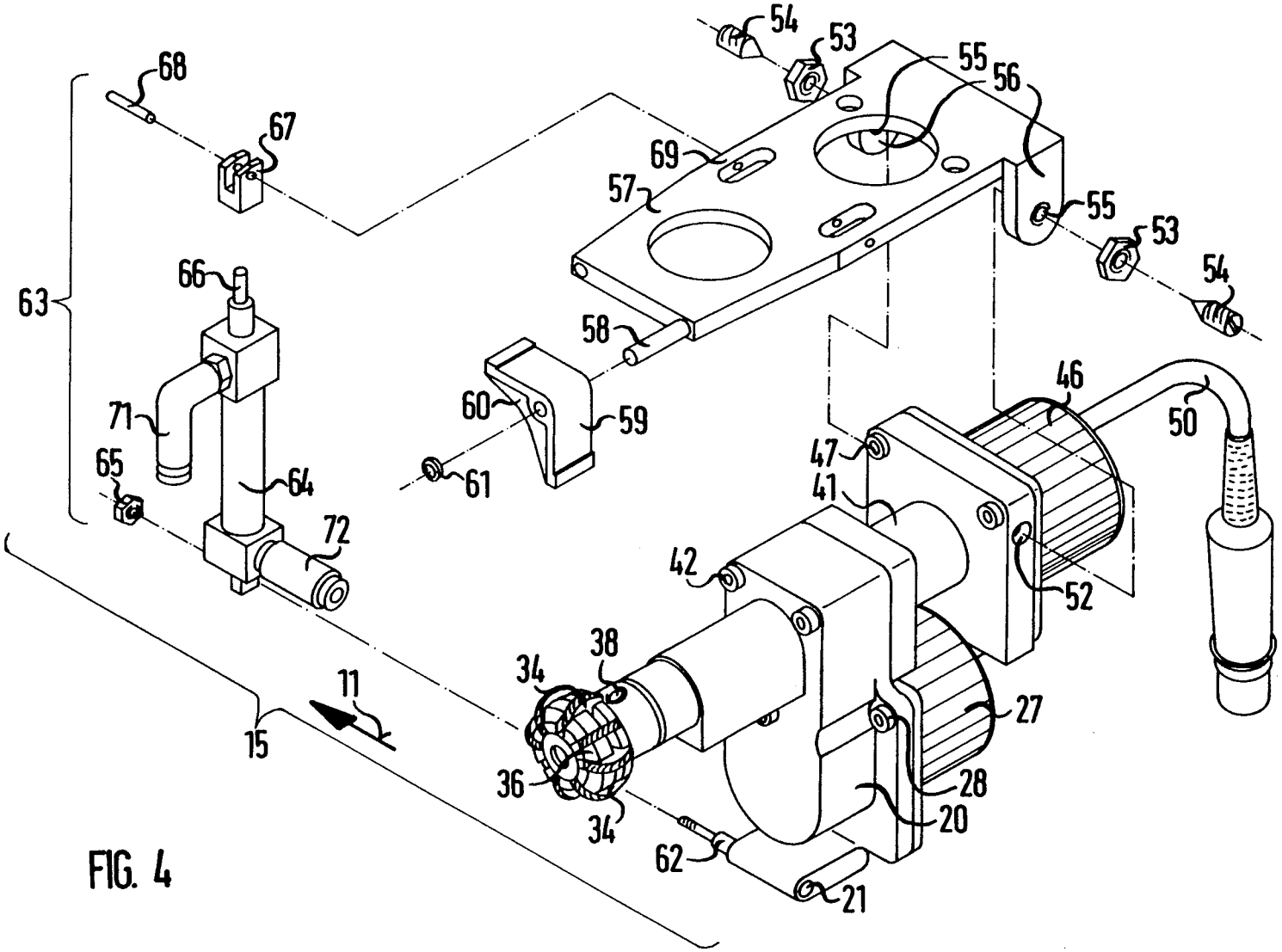
FIG. 4 is an exploded view of a guide device having a drive device in the form of a cylinder drive for moving an abutment up and down.

Referring to FIG. 4, the motors 27 and 46 are connected by way of a lead 50 to a control unit (not shown in the drawing) which drives the motor 46 in a controlled manner in conformity with the signals of the sensor unit 12 which is also connected to the control unit by way of a lead 51. The motor 27 is driven in a controlled manner corresponding to the rate of feed of the workpiece 8 and is electrically connected to the sewing drive. This may be effected by, for example, a known incremental sensor (position sensor) of the sewing machine.

The intermediate flange 41 has openings 52 engaged by pointed screws 54 which are secured by nuts 53 and which are in turn guided in screw threads 55 in lugs 56 of a carrier plate 57 and make it possible for the carrier plate 57 to move up and down. The carrier plate 57 is thus mounted so as to be pivotable about the openings 52.

A pin 58 is secured to the carrier plate 57 and carries a concave abutment 59, pivotable about the pin 58 and having a leaf spring 60 for optimum adaptation to the wheels 34, and a retaining ring 61. The concave construction of the abutment 59 ensures that at least one wheel 34 acts upon the workpiece 8 shown in FIG. 1.

The bottom region of the guide housing 20 has, in the bore 21, a threaded pin 62 which carries a drive device in the form of a cylinder drive 63. A pneumatic cylinder 64 is pivotably mounted at its bottom end on the threaded pin 62 and is secured by a nut 65. A piston rod 66 carries a clevis 67 which is in turn pivotably disposed in a mounting 69 by means of a pin 68.

A pneumatic device (not shown in the drawings) actuates the drive device, in the form of the cylinder drive 63, by way of the pressure medium lines 71 and 72 in such a way that the loading and unloading of the workpiece guide device 15 is facilitated by the raising and lowering of the abutment 59.

The wheels 34 connected to, and driven by, the further motor 46 guide the workpiece 8 transversely to the direction prescribed by the guide wheel 36. The wheels 34 are disposed transversely to the feed direction indicated by the arrow 11, and the guide wheel 36 is disposed in the feed direction. The wheels 34 are to be driven at at least two speeds in opposite directions, which speeds are achieved and controlled by way of the sensor arrangement 12 and by the control unit.

Figure 5:
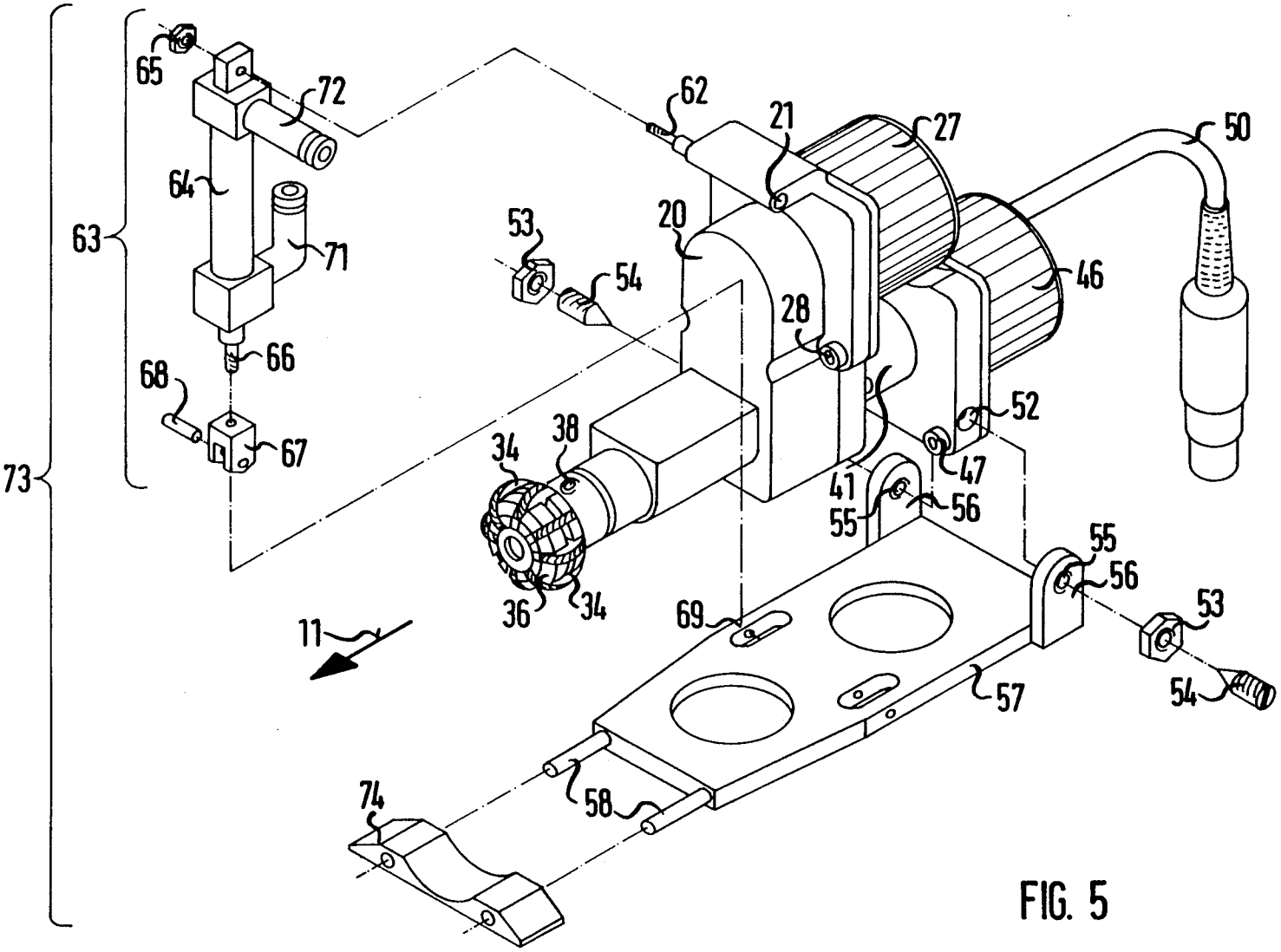
FIG. 5 is an exploded view of a further guide device having a drive device, for moving the guide device up and down.

FIG. 5 shows a further workpiece guide device 73 in which parts of the same construction are provided with the reference numerals of the workpiece guide device 15 and whose carrier plate 57 is secured to, 1 for example, the lengthened workplate 2. The arrow 11 indicates the feed direction of the workpiece 8 from the workpiece guide device 73 towards the stitch-forming location 14. The guide wheel 36 is disposed transversely to the feed direction, and the wheels 34 are disposed in the feed direction. The guide wheel 36 is driven at at least two speeds in opposite directions, which speeds are achieved and controlled by way of the sensor arrangement 12 and by the control unit. The wheels 34 are driven in conformity with feed rate of the workpiece 8.

Two pins 58 are secured to the carrier plate 57 and carry a further concave abutment 74 which is disposed in the region of the entry zone of the presser foot 7. The cylinder drive 63 makes it possible for the guide wheel 36 to move up and down. In a further embodiment (not shown in the drawings}, the cylinder drive 63 may be secured to the sewing head 3 of the sewing machine 1 instead of being secured to the carrier plate 57, in order to make it possible also to align an annular workpiece 8 and not only a flat workpiece 8.

Figure 6:
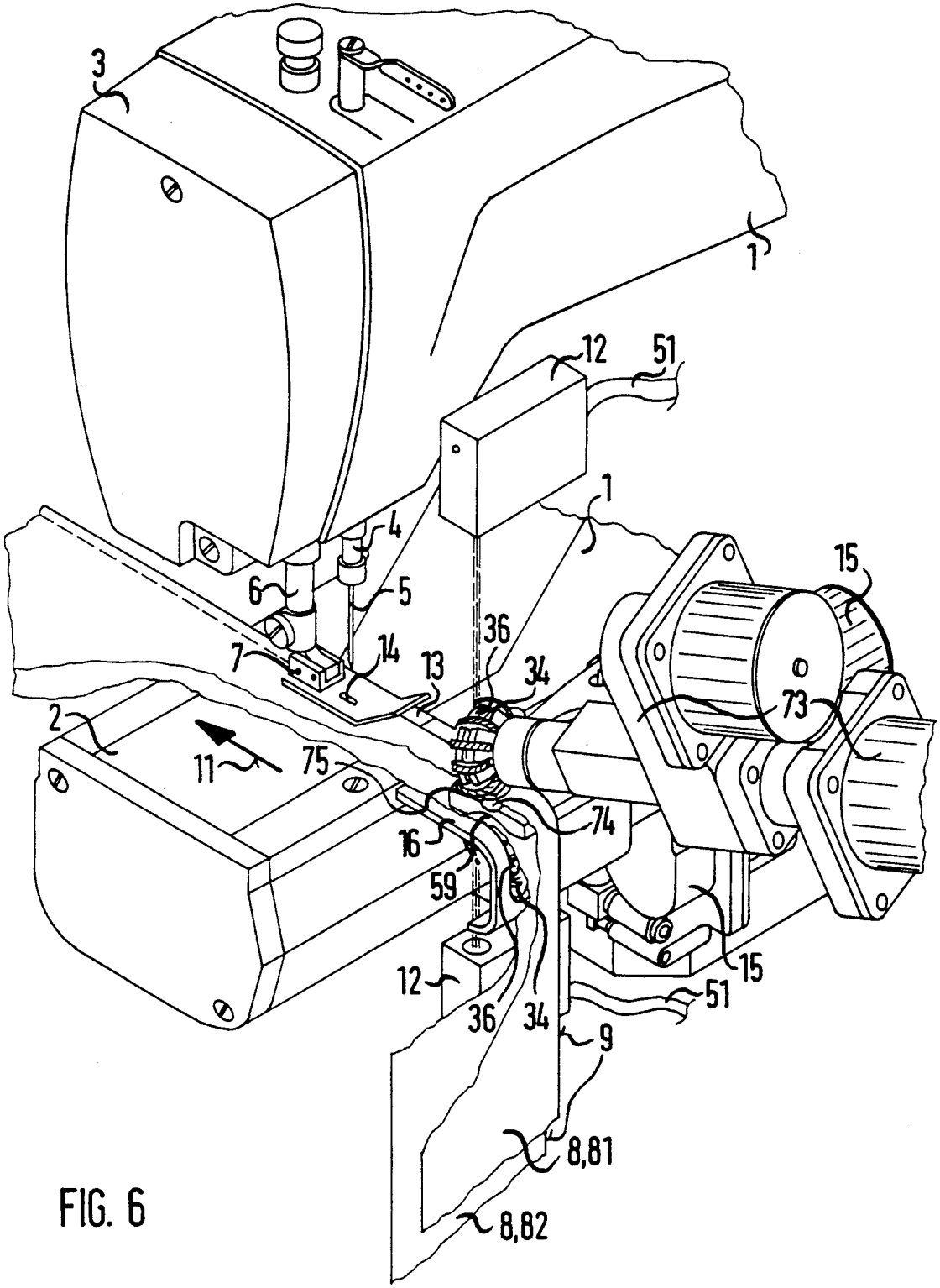
FIG. 6 is a fragmentary, perspective view of a sewing machine having a workpiece guide device in the form of a double workpiece guide device.

The workpiece edge guide device may be in the form of a double workpiece guide, as shown in FIG. 6, in which the guide wheel 36 with the wheels 34 acts upon the top side of a first part 81 of the workpiece 8, and a further guide wheel 36, which also carries wheels 34, acts upon the underside of a further part 82 of the workpiece 8. This makes it possible to sew two parts 81, 82 of a workpiece 8 or two plies of a workpiece 8 together, correctly with respect to their edges 9. In this connection, an intermediate plate 25 between the parts 81, 82 the workpiece 8 serves as an abutment in order to ensure separate control and alignment of the parts 81, 82 of the workpiece 8.

While the above-described embodiments of the invention are preferred, those skilled in this art will recognize modifications of structure, arrangement, composition and the like which do not part from the true scope of the invention. The invention is defined by the appended claims, and all devices and/or methods that fall within the meaning of the claims, either literally or by equivalents, are intended to be embraced therein.

I claim:

1. A workpiece guide device for a sewing machine for automatically aligning an edge of a workpiece with respect to a sewing needle of the sewing machine, the workpiece being movable in a feed direction for allowing the sewing needle to sew the workpiece at a prescribed distance from the edge of the workpiece, the guide device comprising:

a sensor for detecting the edge of the workpiece;

a moveable guide wheel coupled to a first motor for imparting movement to said guide wheel;

an abutment for securing the workpiece between said abutment and said guide wheel such that movement of said guide wheel moves the workpiece in a first direction;

secondary wheels movably positioned around a circumferential side of said guide wheel, said secondary wheels being angularly positioned with respect to the guide wheel in order to contact and guide the workpiece in a second direction;

said secondary wheels coupled to a second motor for imparting movement to said secondary wheels; and said sensor coupled to at least one of said first and second motors for controlling said first and second motors.

2. A device as claimed in claim 1 wherein said second direction is transverse to the feed direction, and said first direction is the same as the feed direction.

3. A device as claimed in claim 1 further comprising drive means for moving said secondary wheels at at least two speeds and in at least two directions, said speeds controlled by said sensor.

4. A device as claimed in claim 1 wherein said first direction is transverse to the feed direction and said second direction is the same as the feed direction.

5. A device as claimed in claim 1 further comprising drive means for moving the guide wheel at at least two speeds and in at least two directions, said speeds controlled by said sensor.

6. A device as claimed in claim 1 further comprising a drive mechanism for moving said guide wheel and said abutment toward and away from one another in order to facilitate loading and unloading of the workpiece in the space between said abutment and said guide wheel.

7. A device as claimed in claim 6 in which said abutment comprises a leaf spring.

8. A device as claimed in claim 6 wherein said abutment is concave and has sufficient length to allow at least one of said secondary wheels to press said workpiece against said abutment.

9. A device as claimed in claim 1 wherein said secondary wheels have peripheral teeth which form a gear mechanism with a worm positioned coaxially with respect to the guide wheel.

10. A device as claimed in claim 1 wherein a second guide wheel having a second set of secondary wheels also contacts the workpiece such that said second guide wheel in capable of moving the workpiece in said second direction and said second set of secondary wheels are capable of moving the workpiece in said first direction.

11. A device as claimed in claim 10 wherein said abutment is positioned between plies of the workpiece, and one ply of the workpiece is positioned between the guide wheel and the abutment while another ply of said workpiece is positioned between said second guide wheel the abutment.

12. A device as claimed in claim 1 wherein said workpiece is flat and substantially non-tubular.

* * * * *

UNITED STATES PATENT AND TRADEMARK OFFICE

CERTIFICATE OF CORRECTION

PATENT NO. : 5,251,557
DATED : October 12, 1993
INVENTOR(S) : Günter Rohr

It is certified that error appears in the above-indentified patent and that said Letters Patent is hereby corrected as shown below:

In column 3, line 61, before "for" delete "1".

In column 4, line 9, after "drawings" delete "}" and substitute therefor --)--.

In column 4, line 23, after "82" insert --of--.

IN THE CLAIMS

In claim 10, line 4, before "capable" delete "in" and substitute therefor --is--.

Signed and Sealed this
Twelfth Day of July, 1994

Bruce Lehman

*Attest:*

BRUCE LEHMAN

*Attesting Officer*

*Commissioner of Patents and Trademarks*